United States Patent [19]

Bohle

[11] Patent Number: 4,775,242

[45] Date of Patent: Oct. 4, 1988

[54] MIXING APPARATUS

[76] Inventor: Lorenz Bohle, Im Luren 5, D-4722 Ennigerloh, Fed. Rep. of Germany

[21] Appl. No.: 142,739

[22] Filed: Jan. 11, 1988

[30] Foreign Application Priority Data

Jan. 12, 1987 [DE] Fed. Rep. of Germany ..... 3700629

[51] Int. Cl.[4] ..... B01F 9/06

[52] U.S. Cl. ..... 366/209; 366/216; 366/225; 366/232; 366/236

[58] Field of Search ..... 366/208, 209, 210, 211, 366/212, 213, 214, 216, 219, 220, 225, 228, 230, 237, 238, 232, 236, 197, 199, 200, 201, 202

[56] References Cited

U.S. PATENT DOCUMENTS

| | | | |
|---|---|---|---|
| 3,086,332 | 4/1963 | Wentz | 366/214 |
| 3,174,728 | 3/1965 | Mack | 366/213 |
| 3,341,183 | 9/1967 | Bergstrom | 366/225 |
| 3,746,316 | 7/1973 | Langen | 366/213 |
| 4,077,613 | 3/1978 | Wilson | 366/213 |
| 4,372,686 | 2/1983 | Herfeld | 366/220 |
| 4,403,865 | 9/1983 | Fejmert | 366/228 |

FOREIGN PATENT DOCUMENTS

| | | | |
|---|---|---|---|
| 583813 | 12/1977 | U.S.S.R. | 366/209 |

*Primary Examiner*—Robert W. Jenkins
*Attorney, Agent, or Firm*—Peter K. Kontler

[57] ABSTRACT

A gravity operated mixing apparatus for pulverulent, granular and liquid materials has an upright vessel with an opening at the top and a sealable pyramidal or conical outlet at the bottom. The opening can be sealed by a closure which carries one or more mixing elements extending into the vessel to contribute to the mixing and/or agglomerating action while the vessel moves up and down and is oscillated or rotated about a horizontal axis to repeatedly raise its contents whereupon the contents descend by gravity and their flow is determined by the number and configuration of mixing elements which need not move relative to the vessel. The vessel can be used as a receptacle for delivery of a charge containing two or more flowable materials to the mixing station as well as for delivery of intermixed materials to the next processing station or stations.

18 Claims, 3 Drawing Sheets

MIXING APPARATUS

BACKGROUND OF THE INVENTION

The present invention relates to mixing apparatus in general, and more particularly to improvements in gravity operated mixing apparatus which can be utilized for intimate mixing of ingredients of pharmaceutical or chemical products.

It is often necessary to produce a mixture of two or more flowable materials preparatory to the making of pills, tablets, granulae and/or analogous pharmaceutical or chemical products. Certain types of flowable materials must be treated in such a way that they are subjected to minimal or negligible wear in the course of the mixing operation. As a rule, such materials should be intensively intermixed within a short interval of time and should form a mixture which is sufficiently homogeneous for immediate conversion into pills, tablets and the like.

Some flowable materials which are used for the making of pills and like chemical and/or pharmaceutical products are of highly toxic nature. Therefore, it is desirable and advantageous to avoid renewed transfer of such toxic materials from vessel to vessel because each transfer can entail the escape of some toxic materials with attendant contamination of the surrounding area and potential injury to the attendants.

Certain presently known mixing apparatus for flowable materials which are to be converted into pills, tablets or like pharmaceutical or chemical products constitute so-called positive or compulsory mixers wherein one or more rotary mixing or stirring elements are driven by one or more motors. The vessel which confines the flowable materials to be intermixed is held at a standstill. An advantage of such positive mixers is that the mixing operation is intensive and can be completed within very short intervals of time. However, such mixers exhibit the drawback that the rapidly rotating stirring or mixing elements are likely to cause a pronounced rubbing action between the particles of the materials to be mixed as well as between such particles and the rotating mixing elements. Moreover, when the mixing of a charge is completed, the resulting product must be transferred from the mixing vessel into a transporting receptacle. By the same token, a fresh charge must be admitted into the mixing vessel from one or more discrete receptacles. All this consumes time and enables certain harmful or potentially harmful ingredients to escape during admission into and/or during evacuation from the mixing vessel.

It is further known to mix two or more flowable materials in so-called gravity operated mixers wherein the mixing vessel is caused to move up and down while rotating about a vertical axis. Such mode of mixing is less likely to subject the particles of flowable materials to extensive wear but the period of mixing is relatively long and the intensity of the mixing action is often unsatisfactory.

OBJECTS AND SUMMARY OF THE INVENTION

An object of the invention is to provide a novel and improved mixing apparatus which combines the advantages of the aforediscussed conventional mixers but avoids their drawbacks.

Another object of the invention is to provide a novel and improved gravity operated mixer for flowable materials which are to be converted into pills, tablets and/or into otherwise configurated particulate or flowable chemical and/or pharmaceutical products.

A further object of the invention is to provide a mixing apparatus which need not be equipped with discrete vessels for the delivery of intermixed flowable materials to the next processing station.

An additional object of the invention is to provide a novel and improved vessel for use in the above outlined apparatus.

Still another object of the invention is to provide novel and improved mixing elements for use in the above outlined apparatus.

Another object of the invention is to provide a novel and improved method of rapidly and intensively but gently mixing two or more flowable materials.

A further object of the invention is to provide the apparatus with novel and improved means for controlling the flow of materials to be intermixed in the interior of the mixing vessel.

An additional object of the invention is to provide a novel and improved apparatus for pelletizing or for preparing for pelletizing two or more flowable materials of the chemical or pharmaceutical industry.

A further object of the invention is to provide an apparatus which can be utilized as a superior substitute for heretofore known gravity operated and/or positive mixers.

An additional object of the invention is to provide a novel and improved apparatus for agglomerating a plurality of miscible ingredients of tablets or like products preparatory to admission into a pelletizing machine.

A further object of the invention is to provide an apparatus which can readily handle toxic or other harmful flowable materials without endangering the attendants and/or contaminating the surrounding area.

The invention is embodied in a mixing apparatus, particularly in a gravity operated mixer of pharmaceutical or chemical products. The apparatus comprises a combined transporting and storage vessel which serves to confine the products to be mixed and has a sealable opening, means for moving the vessel including means for raising and lowering the vessel and for imparting to the vessel an angular movement about a predetermined axis (e.g., about a substantially horizontal axis), means for separably coupling the vessel to the moving means cover or a closure for the opening, and at least one mixing element provided on the closure and extending into the interior of the vessel when the closure is applied to the vessel to seal the opening. The mixing element is inclined with reference to the predetermined (preferably substantially horizontal) axis. The vessel is further preferably provided with an outlet for mixed products, and such outlet is preferably located opposite and is spaced apart from the opening. The mixing element preferably includes a substantially plate-like body which extends substantially in a direction from the opening toward the outlet in applied position of the closure.

The outlet preferably tapers in a direction away from the opening and includes a portion of maximum cross-sectional area at a predetermined distance from the opening. In accordance with a presently preferred embodiment, the mixing element extends from the opening at least close to the aforementioned portion of the outlet in the applied position of the closure.

The mixing element can have two concave sides which face away from each other. Alternatively, the mixing element can be configurated in such a way that it has an arcuate (concave or convex) side facing toward the adjacent portion of the internal surface of the vessel and a substantially plane side facing away from the arcuate side.

The apparatus can comprise a substantially round closure which carries two mixing elements disposed at opposite sides of the center of the closure. If the apparatus comprises a single mixing element, such single element can be located substantially centrally of the closure.

The coupling means can comprise at least one female coupling element on the vessel and at least one male coupling element which is receivable in the female coupling element and is provided on the moving means.

In accordance with a modification, the coupling means can comprise a substantially L-shaped arm which turns about the predetermined axis in actual use of the apparatus. The arm has a first portion which extends substantially radially of the predetermined axis and a second portion which is substantially parallel to such axis and is connected to or connectable with the closure, i.e., the second portion of the arm can be separably affixed to the vessel and the closure can form part of the means for coupling the vessel to the moving means.

The apparatus can employ a substantially round (e.g., substantially cylindrical) vessel with a conical outlet at one axial end and with the aforementioned opening at the other axial end. Alternatively, the apparatus can employ a vessel which has a polygonal (e.g., square or rectangular) cross-sectional outline and an outlet which is a pyramid and is disposed at one end of the vessel. The other end of such vessel is provided with the aforementioned opening.

The vessel can be provided with an understructure (e.g., in the form of a skeleton frame) which extends beyond the outlet and can serve as a support which contacts the ground when the coupling means is inoperative (i.e., when the vessel is uncoupled from the moving means).

The closure can be provided with one or more handles to facilitate its manipulation, namely attachment to or detachment from the vessel so as to respectively seal and expose the opening.

The predetermined axis is preferably disposed between the outlet and the opening of the vessel.

Each mixing element can be rigid with (e.g., an integral part of) the closure.

The moving means can comprise an elevator which serves to move the vessel up and down, and a drive which is interposed between the elevator and the coupling means and serves to impart to the vessel the aforementioned angular (rotary or oscillatory) movement.

The novel features which are considered as characteristic of the invention are set forth in particular in the appended claims. The improved mixing apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is a side elevational view of the entire apparatus including the means for moving the vessel and the means for coupling the vessel to the moving means, a wheel-mounted conveyance being shown at a level below the conical outlet of the vessel;

DESCRIPTION OF THE PREFERRED EMBODIMENTS

Figure 1:
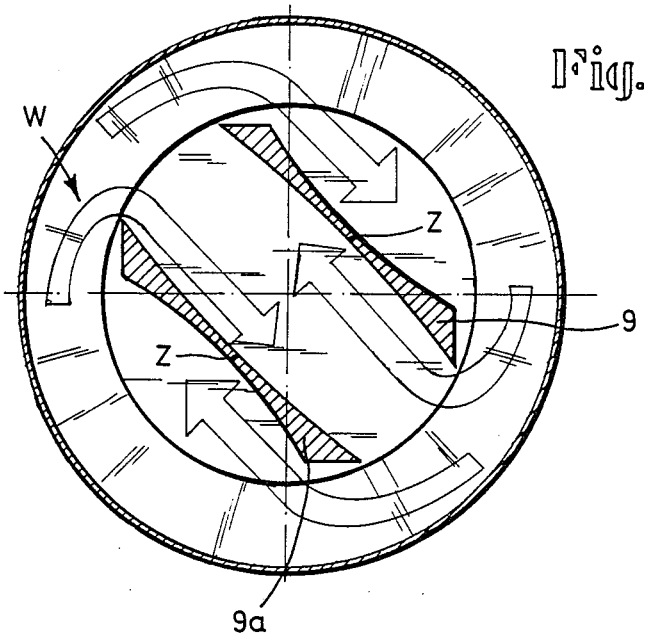
FIG. 1 is a horizontal sectional view of a substantially cylindrical vessel and two mixing elements for use in a mixing apparatus which embodies one form of the invention, the section being taken in the direction of arrows as seen from the line 1—1 of FIG. 2.

Referring first to FIGS. 1 to 4, there is shown a mixing apparatus which comprises a moving unit including an upright column 1 containing an elevator 2 which is movable up and down by a drive 3 including a reversible electric motor or another suitable prime mover. The elevator 2 carries a rotating or oscillating drive 4 of known design which can turn a substantially cylindrical vessel 8 about a horizontal axis (note the axis X—X in FIG. 4) while the elevator 2 moves up and down so that the vessel then perform a composite movement including a movement up and down longitudinally of the column 1 as well as at least one angular movement about a substantially horizontal axis. The moving unit further comprises an eccentric 5 which is rotated by the drive 4 and carries the male components 7 of a coupling which separably connects the vessel 8 to the moving unit 1–5. The female components of the coupling are parallel sleeves 6 which are affixed to opposite sides of a hollow conical outlet 14 of the vessel 8 and can receive the male coupling components 7 to thus ensure that the vessel 8 is compelled to share all movements of the eccentric 5 including those longitudinally of the column 1 as well as those about the horizontal axis. The lower end portion (apex) of the conical outlet 14 is sealed when the apparatus is in use, i.e., when the vessel 8 contains a charge of two or more pharmaceutical products which are to be intimately mixed with each other in response to operation of the drives 3 and 4. The male coupling components 7 are received in the female components 6 with requisite friction to ensure that the vessel 8 cannot move away from the column 1 when the mixing apparatus is in use, or the free ends of the male components 7 can carry nuts, split rings or other means for preventing any movements of the components 7 longitudinally of the respective components 6 and/or vice versa before the outlet 14 comes to rest on a wheel-mounted conveyance 11 which can be used to transport the vessel 8 to a station where the vessel can be relieved of the freshly mixed goods and can receive a fresh charge of two or more products which are to be intimately mixed with each other upon renewed introduction of male coupling components 7 into the respective female coupling components 6.

Figure 2:
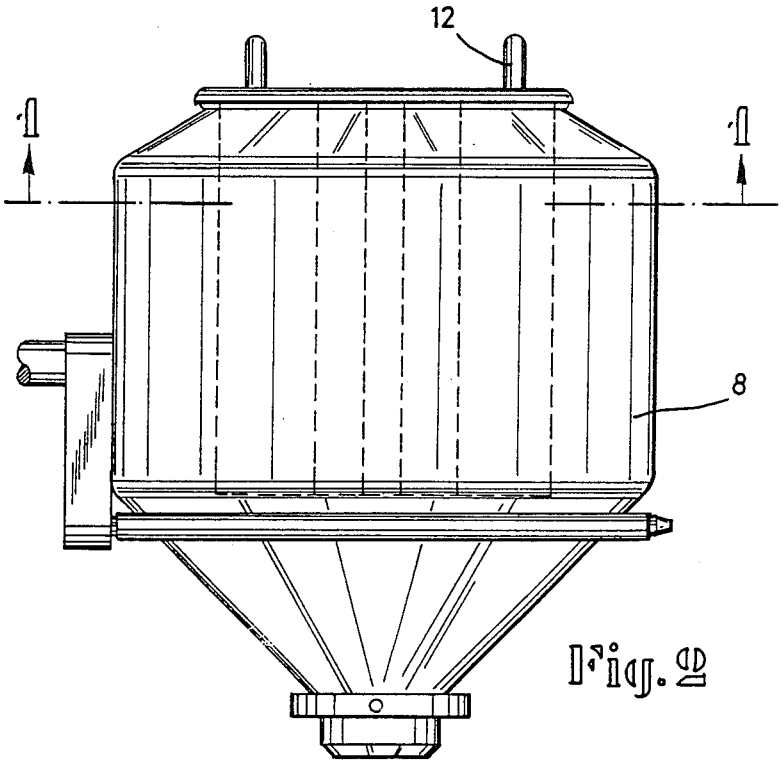
FIG. 2 is a side elevational view of the vessel, further showing the cover in applied position so as to seal the opening at the upper axial end of the vessel.
Figure 4:
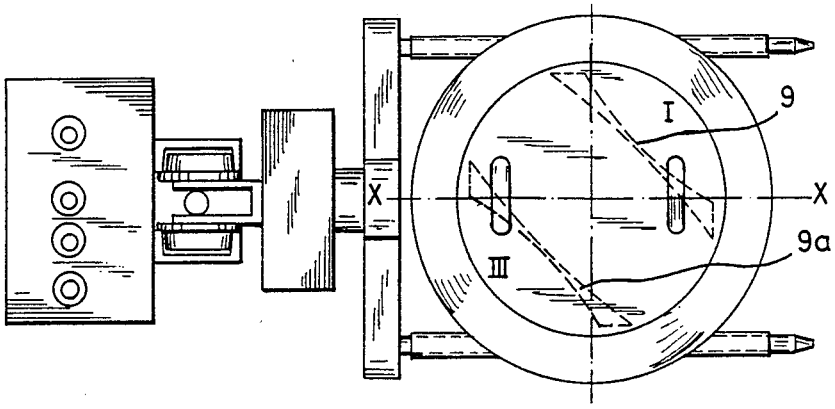
FIG. 4 is a plan view of the apparatus which is shown in FIG. 3.

The upper end portion of the vessel 8 (as seen in FIGS. 2, 3 and 4) has an opening which serves for admission of the products to be mixed and which can be sealed and closed by a circular disc-shaped closure or cover 10 having two substantially semicircular handles 12 to facilitate its manipulation, namely its placing on top or its removal from the top of the vessel 8. The closure 10 is permanently or separably connected with two substantially plateor blade-like mixing elements 9 and 9*a* which extend toward but short of the discharge end of the outlet 14 and each of which can have two concave sides one of which faces toward the adjacent portion of the internal surface of the vessel 8 and the other of which faces away from the one side, namely toward the other mixing element. As can be seen in FIGS. 1 and 4, the centers Z of the mixing elements 9 and 9*a* are respectively located in the first (I) and third (III) quadrants of the circular opening in the top portion of the vessel 1 when the apparatus is idle so that the opening is located at the top and the outlet 14 is located a the bottom of the vessel 8. It can be said that the centers Z of the mixing elements 9 and 9*a* are located at opposite sides of the center of the circular closure 10 and on a diameter which includes the center of the closure and extends substantially at right angles to the planes of the substantially plate-like mixing elements. In the embodiment of FIGS. 1 to 4, the lower end portions of the mixing elements 9 and 9*a* extend to the general level of the maximum-diameter portion of the outlet 14 or even slightly into the interior of the outlet. This is shown in FIG. 3 by broken lines. The manner in which the closure 10 can be separably affixed to the respective end of the vessel 8 (e.g., by a bayonet mount or in an analogous way) is not shown because it forms no part of the present invention. All that counts is to ensure that the closure 10 can be detached from the vessel 8 so as to allow for extraction of the mixing elements 9 and 9*a* from the interior of the vessel so that the opening, which is normally sealed by the closure 10, is accessible for admission of a fresh charge of products which are to be mixed with each other. FIG. 4 shows that the planes of the mixing elements 9 and 9*a* are inclined with reference to the axis X—X about which the vessel can turn or which is parallel to the axis of rotation of the vessel. The common axis of the conical outlet 14 and the cylindrical portion of the vessel 8 is shown in FIG. 3, as at Y—Y.

FIG. 1 shows that the mixing elements 9 and 9*a* are solid plate-like bodies each of which has a rather pronouncedly concave side facing the nearest portion of the internal surface of the vessel 8 and a slightly concave or plane side opposite the pronouncedly concave side. If desired, the mixing elements 9 and 9*a* can be provided with slots (e.g., in planes parallel to the plane of FIG. 1) so as to permit for a flow of the constituents of the confined charge between the two sides of each mixing element when the apparatus is in use.

The arrows W indicate in FIG. 1 the flow of the confined charge when the moving unit 1–5 is operative to move the vessel 8 (with the closure 10 properly affixed thereto) up and down longitudinally of the column as well as about a horizontal axis to bring about a thorough mixing action in part by gravity, in part under the action of centrifugal force and in part as a result of repeated impingement of the constituents of confined charge upon the internal surface of the vessel 8 (including the outlet 14), upon the inner side of the closure 10 and upon the sides of the mixing elements 9 and 9*a*. The drive 4 can be designed to cause the eccentric 5 to complete full revolutions or to oscillate back and forth; all that counts is to ensure that the confined constituents of the ultimate mixture are caused to repeatedly rise and thereupon descend by gravity while being deflected by the sides of the mixing elements 9, 9*a* as well as by the internal surface of the vessel 8 and the inner side of the closure 10. It has been found that such mode of agitating the confined constituents brings about a highly satisfactory intensive but gentle mixing action which is completed within a reasonably short interval of time and does not necessitate any movements of the closure 10 and/or mixing elements 9, 9*a* relative to the vessel 8.

When the mixing operation is completed, the closure 10 is detached (e.g., by hand through the medium of the handgrip members 12) to extract the mixing elements 9, 9*a* from the interior of the vessel 8, and (if necessary) the opening of the vessel 8 is then sealed by a different closure (not shown) which remains applied while the vessel 8 is deposited on the conveyance 11 and is transported to the next processing station for the freshly mixed product.

Figure 5:
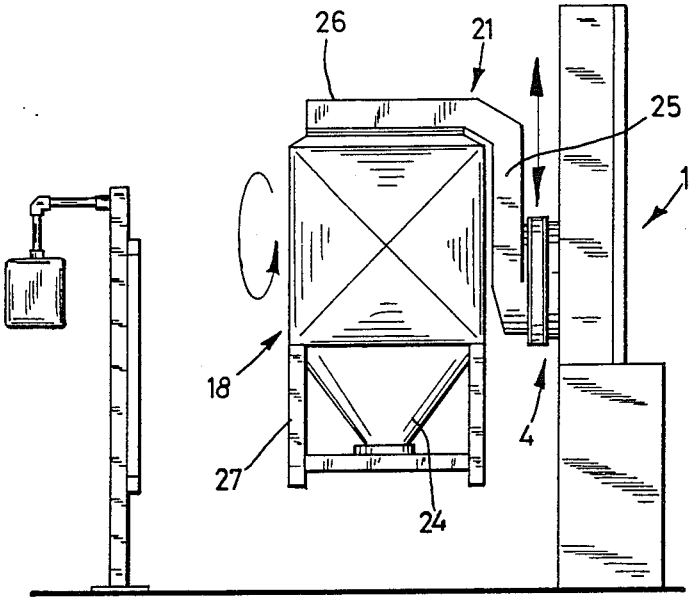
FIG. 5 is a side elevational view of a modified apparatus wherein the coupling means is permanently or substantially permanently connected to the closure for the opening in a modified vessel having a polygonal cross-sectional outline.
Figure 6:
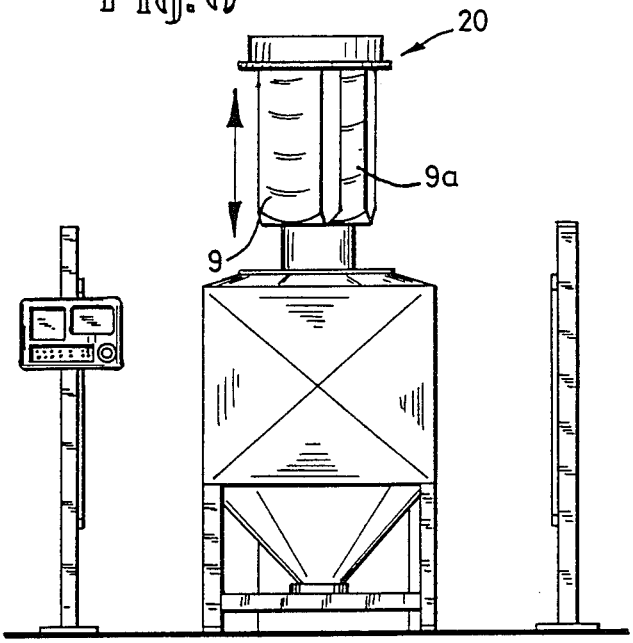
FIG. 6 is a front elevational view of the modified apparatus with the vessel detached from the closure. so that its understructure rests on the ground.
Figure 5:
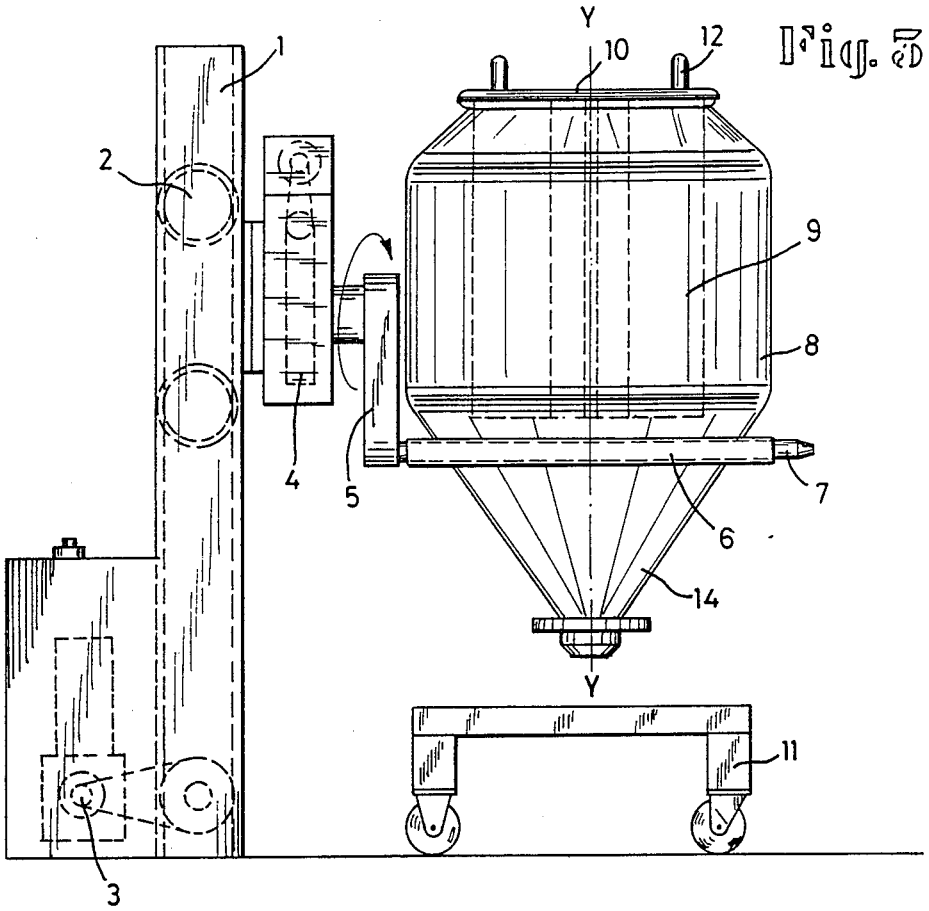

FIGS. 5 and 6 show a modified mixing apparatus wherein the vessel 18 has a substantially square cross-sectional outline and includes a substantially pyramidal outlet 24 disposed within the confines of an understructure 27 in the form of a skeleton frame which can come to rest on the ground (e.g., on the floor in a plant) when the vessel 18 is uncoupled from the moving unit including the column 1. The coupling means 21 comprises a sustantially L-shaped arm having a first portion 25 which extends substantially at right angles to the horizontal axis of rotation or oscillation of the vessel 18 under the action of the drive 4, and a second portion 26 which is substantially parallel to but is spaced apart from such axis and is directly connected to the closure 20 which carries the mixing elements 9 and 9*a*. The closure 20 can be bolted, clamped or otherwise separably affixed to the open upper end of the vessel 18 to thereby lift the vessel and to set it in rotary motion in order to thoroughly intermix the constituents of flowable material which is confined in the interior of the vessel for the purpose of mixing. When the mixing operation is completed, the closure 20 deposits the vessel 18 on the ground and is lifted above and away from the vessel so that the latter can be engaged and transported by a conventional fork lift or any other suitable vehicle replacing the conveyance 11 of FIG. 3.

The understructure 27 can be permanently or separably affixed to the main portion of the vessel 18. Instead of having a square cross-sectional outline, this vessel can have a rectangular or another polygonal outline. It is also possible to employ a vessel having a substantially oval or other more complex cross-sectional outline.

An advantage of the apparatus of FIGS. 5 and 6 is that it can employ a simple coupling which is or can be permanently connected to the closure 20 so that the latter can be manipulated by the moving unit for the vessel 18. In addition, the understructure 27 renders it possible to dispense with a specially designed conveyance (such as 11) and to manipulate the vessel 18 by available transporting means including fork lifts and the like.

Figure 7:
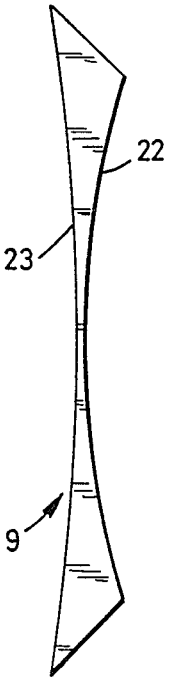
FIG. 7 is an enlarged end elevational view of a mixing element which can be utilized in the improved apparatus.

FIG. 7 is an end elevational view of a presently preferred mixing element 9. This mixing element has a pronouncedly concave side 22 and a less concave or plane or nearly plane side 23.

If the closure 10 or 20 carries a single mixing element (such as the element 9 or 9a), the center of the mixing element is preferably located close to or coincides with the center of the cover. In other words, such single mixing element is then installed substantially midway between the mixing elements 9, 9a which are shown in FIG. 1.

An important advantage of the improved apparatus is that the mobile vessel 8 or 18 can be moved to the locus of admission of flowable materials into its interior and to the next processing station so that the number of times the materials to be mixed must be transferred from vessel to vessel is reduced with attendant reduction of the likelihood of contamination of the surrounding area and potential harm to the attendants.

Another important advantage of the improved apparatus is that the mixing element or elements need not be positively rotated and/or otherwise moved relative to the vessel in the course of a mixing operation. This greatly reduces the likelihood of excessive abrasion of particles of flowable material without necessitating a much longer period of mixing. This is due to the fact that the mixing element or elements in the interior of the vessel 8 or 18 participate in the mixing action but in a manner which is different from that in a positive mixer. Thus, the concave and/or convex and/or flat sides of the mixing element or elements repeatedly change the direction of flow of materials in the interior of the vessel when the latter is subjected to a combined reciprocatory and angular movement. It has been found that such mode of mixing ensures the formation of a highly homogeneous mixture within a surprisingly short interval of time. The mixing action is highly satisfactory regardless of whether the drive 4 is used to merely oscillate the vessel 8 or 18 back and forth (e.g., to produce a pendulum action) or whether the drive 4 is designed or set up to cause the vessel 8 or 18 to perform a series of complete revolutions about a substantially horizontal axis. The confined flowable materials are lifted and then allowed to descend by gravity at desired intervals, and each such flow of confined materials is controlled, at least to a considerable extent, by the mixing element or elements in the interior of the vessel in spite of the fact that the position or positions of the mixing element or elements with reference to the vessel need not change when the mixing apparatus is in actual use. It was further ascertained that the mixing action is particularly satisfactory and intensive if the mixing elements are arranged in a manner as shown in FIG. 1, i.e., if the flow of confined materials is controlled by a plurality of mixing elements which are in a uniform distribution with reference to each other and the axis of the vessel and/or its closure.

When the mixing of a batch of confined flowable materials is completed, the vessel 8 or 18 can be transported to a pelletizing or tablet making machine wherein its contents are converted into shaped products of desired size and/or shape. As explained above, the closure 10 or 20 can be replaced with a closure which is without one or more mixing elements and is used during transport or shifting of the vessel 8 or 18 to the next processing station, e.g., to a pelletizing or tablet making station.

It was further ascertained that the improved apparatus can be used as a means for agglomerating or pelletizing the flowable materials which are confined in the vessel 8 or 18. For example, a pulverulent material can be contacted by a predetermined (normally relatively small) quantity of a liquid bonding or agglomerating medium before the vessel is caused to perform the aforedescribed composite movement under the action of the moving unit. This results in the conversion of pulverulent material into agglomerations of particles which can be used in the thus obtained form or are thereupon immediately admitted into a final pelletizing machine. Such treatment is often desirable in the pharmaceutical industry. The admission of accurately metered quantities of moisture into the vessel 8 or 18 can be preceded by intensive intermixing of two or more flowable solid materials.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A mixing apparatus, particularly a gravity operated mixer of pharmaceutical products, comprising a combined transporting and storage vessel for the products to be mixed, said vessel having a sealable opening; means for moving said vessel including means for raising and lowering the vessel and for imparting thereto an angular movement about a predetermined axis; means for separably coupling said vessel to said moving means; a closure for said opening; and at least one mixing element provided on said closure and extending into the interior of said vessel when the closure is applied to said vessel, said mixing element being inclined. with reference to said predetermined axis.

2. The apparatus of claim 1, wherein said vessel has an outlet for mixed products, said outlet being disposed substantially opposite said opening and said mixing element including a substantially plate-like body extending substantially in a direction from said opening toward said outlet in the applied position of said cover.

3. The apparatus of claim 2, wherein said outlet tapers in a direction away from said opening and includes a portion of maximum cross-sectional area at a predetermined distance from said opening, said mixing element extending from said opening at least close to said portion of said outlet in the applied position of said closure.

4. The apparatus of claim 2, wherein said mixing element has two concave sides facing away from each other.

5. The apparatus of claim 2, wherein said vessel has an internal surface and said mixing element has an arcuate side facing toward said internal surface and a substantially plane side facing away from said arcuate side.

6. The apparatus of claim 2 wherein said closure is substantially round and carries two mixing elements disposed at opposite sides of the center of said round closure.

7. The apparatus of claim 2, wherein said mixing element is located substantially centrally of said closure.

8. The apparatus of claim 2, wherein said coupling means comprises at least one female coupling element on said vessel and at least one male coupling element receivable in said female coupling element and provided on said moving means.

9. The apparatus of claim 2, wherein said coupling means comprises an arm arranged to turn about said axis and having a first portion extending substantially radially of said axis and a second portion substantially parallel with said axis and separably affixed to said vessel.

10. The apparatus of claim 2, wherein said vessel is substantially round and said outlet has a conical shape.

11. The apparatus of claim 2, wherein said vessel has a polygonal outline and said outlet has a substantially pyramidal shape.

12. The apparatus of claim 2, wherein said vessel has an understructure which extends beyond said outlet to support the vessel on the ground when the vessel is uncoupled from said moving means.

13. The apparatus of claim 2, wherein said closure forms part of said coupling means.

14. The apparatus of claim 2, wherein said axis is located between said opening and said outlet.

15. The apparatus of claim 1, wherein said closure has at least one handle.

16. The apparatus of claim 1, wherein said moving means comprises an elevator arranged to move said vessel up and down and a drive interposed between said coupling means and said elevator and arranged to impart to the vessel said angular movement.

17. The apparatus of claim 1, wherein said mixing element is rigid with said closure.

18. The apparatus of claim 1, wherein said predetermined axis is a substantially horizontal axis.

* * * * *